US009073741B2

(12) United States Patent
Jannatkhah

(10) Patent No.: US 9,073,741 B2
(45) Date of Patent: Jul. 7, 2015

(54) BEVERAGE DISPENSING SYSTEM

(71) Applicant: IGUSA, LLC, Atlanta, GA (US)

(72) Inventor: Mehdi Jannatkhah, Marietta, GA (US)

(73) Assignee: IGUSA LLC, Atlanta, GA (US)

( * ) Notice: Subject to any disclaimer, the term of this patent is extended or adjusted under 35 U.S.C. 154(b) by 0 days.

(21) Appl. No.: 13/770,441

(22) Filed: Feb. 19, 2013

(65) Prior Publication Data

US 2014/0151402 A1 Jun. 5, 2014

Related U.S. Application Data

(60) Provisional application No. 61/731,692, filed on Nov. 30, 2012.

(51) Int. Cl.

| | |
|---|---|
| ***B67D 1/08*** | (2006.01) |
| ***B67D 1/16*** | (2006.01) |
| ***B67D 3/00*** | (2006.01) |
| ***B67D 1/00*** | (2006.01) |

(52) U.S. Cl.

CPC ..... *B67D 1/0858* (2013.01); *B67D 1/16* (2013.01); *B67D 3/0009* (2013.01); *B67D 1/0004* (2013.01); *B67D 2001/0821* (2013.01); *B67D 2210/00036* (2013.01)

(58) Field of Classification Search

CPC ..... B67D 1/06; B67D 1/04
USPC ..... 222/108, 146.6, 399, 143, 136, 144.5, 222/130, 129.1; 62/441, 457.1
See application file for complete search history.

(56) References Cited

U.S. PATENT DOCUMENTS

| | | | | | |
|---|---|---|---|---|---|
| 1,531,558 | A | * | 3/1925 | Lehmann | 312/334.39 |
| 1,703,284 | A | * | 2/1929 | Wolfe | 222/108 |
| 1,866,466 | A | * | 7/1932 | Hassensall | 222/108 |
| 2,052,466 | A | * | 8/1936 | Heise et al. | 62/377 |
| 2,085,274 | A | | 6/1937 | Rutt et al. | |
| 2,086,832 | A | * | 7/1937 | Vincent | 312/140.1 |
| 2,134,865 | A | * | 11/1938 | Essery | 222/130 |
| 2,168,059 | A | * | 8/1939 | Buttner | 137/12.5 |
| 2,199,718 | A | * | 5/1940 | Ayers | 62/444 |
| 2,253,884 | A | * | 8/1941 | Beecher | 137/208 |
| 2,257,070 | A | * | 9/1941 | Perlick | 62/393 |

(Continued)

FOREIGN PATENT DOCUMENTS

| | | |
|---|---|---|
| DE | 9103095.1 | 6/1991 |
| DE | 20302949 | 7/2003 |

(Continued)

OTHER PUBLICATIONS

PCT Appl. No. PCT/US2013/069668—EP International Search Report & Written Opinion mailed Feb. 28, 2014.

*Primary Examiner* — Paul R Durand
*Assistant Examiner* — Donnell Long
(74) *Attorney, Agent, or Firm* — Kilpatrick Townsend & Stockton LLP

(57) ABSTRACT

The present disclosure relates generally to systems and methods for dispensing beverages, and more specifically, systems and methods for dispensing beer. In some embodiments, the beverage dispensing units are modular and portable and may be installed in any suitable existing establishment. In some embodiments, the units are configured to allow for the dispensing of draft beer without substantial modifications to the structure of the existing establishment.

35 Claims, 9 Drawing Sheets

(56) References Cited

U.S. PATENT DOCUMENTS

| | | | | |
|---|---|---|---|---|
| 2,259,852 | A * | 10/1941 | Hall | 62/376 |
| 2,294,118 | A * | 8/1942 | Leary | 222/173 |
| 2,345,840 | A * | 4/1944 | Strong | 137/613 |
| 2,750,076 | A | 6/1956 | Welty et al. | |
| 2,774,229 | A * | 12/1956 | Thau et al. | 62/306 |
| 2,955,726 | A * | 10/1960 | Feldman et al. | 222/129.1 |
| 2,956,418 | A | 10/1960 | McCann | |
| 3,180,529 | A * | 4/1965 | Buffington | 222/131 |
| 3,195,779 | A | 7/1965 | Nicko | |
| 3,305,136 | A * | 2/1967 | Harris | 222/129.1 |
| 3,712,514 | A | 1/1973 | Leblanc | |
| 4,356,937 | A * | 11/1982 | Simon et al. | 222/129.2 |
| 4,573,603 | A * | 3/1986 | Starling et al. | 220/605 |
| 4,586,347 | A * | 5/1986 | McCarty | 62/265 |
| 4,901,887 | A * | 2/1990 | Burton | 222/131 |
| 4,928,853 | A | 5/1990 | Isham et al. | |
| 5,094,388 | A * | 3/1992 | Chapman, Jr. | 239/29.3 |
| 5,251,790 | A * | 10/1993 | Cohn et al. | 222/146.6 |
| 5,339,986 | A | 8/1994 | Mihalich | |
| 5,427,276 | A | 6/1995 | Knuettel, II et al. | |
| 5,915,602 | A | 6/1999 | Nelson | |
| 6,010,043 | A | 1/2000 | Williamson et al. | |
| 6,055,823 | A * | 5/2000 | Baker et al. | 62/265 |
| 6,082,590 | A | 7/2000 | Dorsey et al. | |
| 6,422,422 | B1 * | 7/2002 | Forbes | 222/66 |
| 6,679,400 | B1 | 1/2004 | Goodman | |
| 7,036,895 | B2 * | 5/2006 | Han | 312/404 |
| 7,721,568 | B1 | 5/2010 | Grutza, Jr. | |
| 7,756,604 | B1 | 7/2010 | Davis et al. | |
| 7,806,299 | B2 | 10/2010 | Wauters et al. | |
| 7,861,892 | B1 | 1/2011 | White et al. | |
| 8,231,036 | B2 * | 7/2012 | Campbell et al. | 224/527 |
| 8,690,016 | B2 * | 4/2014 | Anderson et al. | 222/129.1 |
| 2004/0026946 | A1 * | 2/2004 | Reed et al. | 296/24.3 |
| 2005/0132740 | A1 * | 6/2005 | Kwon | 62/441 |
| 2005/0161065 | A1 | 7/2005 | Blansit et al. | |
| 2005/0194399 | A1 | 9/2005 | Proctor | |
| 2006/0162370 | A1 | 7/2006 | Haskayne | |
| 2006/0266823 | A1 | 11/2006 | Passen et al. | |
| 2007/0056990 | A1 * | 3/2007 | Pakkert et al. | 222/146.6 |
| 2007/0245765 | A1 | 10/2007 | Casher | |
| 2007/0272742 | A1 | 11/2007 | Gosi et al. | |
| 2009/0125457 | A1 | 5/2009 | Farhan et al. | |
| 2009/0276088 | A1 | 11/2009 | Ruddy | |
| 2010/0084426 | A1 * | 4/2010 | Devers et al. | 222/2 |
| 2010/0139493 | A1 | 6/2010 | Nevarez et al. | |
| 2010/0230434 | A1 * | 9/2010 | Dalton et al. | 222/1 |
| 2010/0237100 | A1 | 9/2010 | Broussard | |
| 2010/0276452 | A1 * | 11/2010 | Vesborg et al. | 222/144.5 |
| 2011/0000250 | A1 | 1/2011 | Sommerfield et al. | |
| 2011/0017776 | A1 * | 1/2011 | Metropulos et al. | 222/129.1 |
| 2011/0108240 | A1 * | 5/2011 | Bax | 165/104.19 |
| 2011/0168775 | A1 | 7/2011 | Van Zetten | |
| 2011/0298583 | A1 | 12/2011 | Libby et al. | |
| 2011/0301768 | A1 | 12/2011 | Hammonds et al. | |
| 2012/0059513 | A1 | 3/2012 | Perkins et al. | |
| 2012/0067076 | A1 | 3/2012 | Schroeder et al. | |
| 2012/0132673 | A1 * | 5/2012 | Leyva | 222/146.6 |
| 2012/0187153 | A1 | 7/2012 | Burge et al. | |
| 2013/0085599 | A1 | 4/2013 | Nicol et al. | |
| 2014/0110018 | A1 | 4/2014 | Scarvelli | |
| 2014/0124094 | A1 | 5/2014 | Afghani | |

FOREIGN PATENT DOCUMENTS

| | | |
|---|---|---|
| EP | 1386880 | 2/2004 |
| WO | WO 2007007144 | 1/2007 |
| WO | WO 2012017127 | 2/2012 |

* cited by examiner

BEVERAGE DISPENSING SYSTEM

CROSS REFERENCE TO RELATED APPLICATIONS

This application claims priority benefits from U.S. Provisional Application Ser. No. 61/731,692 filed on Nov. 30, 2012 and titled "Beverage Dispensing System," the contents of which are incorporated herein by reference.

FIELD OF THE INVENTION

Systems and methods relate to dispensing beverages, and more specifically, systems and methods for dispensing beer.

BACKGROUND

Specialty and handcrafted beers have gained popularity and industry has developed for making such beers available and transportable. A growler is a glass or ceramic jug that is used to transport draft beer. Growlers are sold at breweries and brewpubs as a means to sell take-out beer. Traditionally, the availability of draft beer has been limited to establishments that have been specifically configured to provide it, as the installation, integration, and maintenance costs associated with providing draft beer are prohibitive.

SUMMARY

The present disclosure relates generally to systems for dispensing beverages, including, for example, dispensing beer into containers, glasses, growlers, and the like. Provided in the present disclosure is a beverage dispensing system that includes a refrigerated housing with an interior space having a depth and width. The refrigerated housing includes at least a front, two sides, and a back. The refrigerated housing further includes one or more doors and one or more fixed panels on the front, side(s) or back of the refrigerated housing. The door(s) and the fixed panel(s) each have an exterior portion and an interior portion. The interior portion of the door(s) or the fixed panel(s) includes at least one connection point for at least one tap. Various portions of the refrigerated housing optionally include shelving and/or lights.

The beverage dispensing system further includes at least one tap, which in some embodiments is positioned on or adjacent the exterior portion of the door(s) or the fixed panel(s) or at any other suitable position along the side(s) or front of the refrigerated housing.

The system also includes a sink. The sink is positioned beneath one or more taps. A condensing unit is also included, and the condensing unit is optionally positioned atop or on the side of the refrigerated housing. The beverage dispensing system also includes a drainage connection and drainage tubing. The drainage tubing of the drainage connection has two ends, and the proximal end of the drainage tubing is attached to the sink. The distal end is optionally attached to or leads to a drain, a pump, or a reservoir.

The beverage dispensing system optionally has a door on the back and at least one tap on the exterior portion of the front or the side of the refrigerated housing. The interior portion of the same front or side also includes at least one connection point for the at least one tap. The interior portion of the refrigerated housing optionally includes shelving.

The disclosed beverage dispensing system is a stand-alone, modular system that is easy to install and remove. As such, the system may be installed and used in various establishments, such as but not limited to, brewpups, restaurants, gas stations, convenience stores, bars, liquor stores, hotels, grocery stores, and the like. In this way, draft beer may be provided at locations where it was otherwise unavailable due to the high overhead and installation costs associated with providing, integrating, connecting, and maintaining a system for dispensing draft beer.

These and other features and advantages of the implementations of the present disclosure will become ore readily apparent to those skilled in the art upon consideration of the following detailed description and accompanying drawings, which describe both the preferred and alternative implementations of the present disclosure.

Embodiments of the beverage dispensing system are defined by the claims below, not this summary. This summary is a high-level overview of various aspects of the system and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings and each claim.

BRIEF DESCRIPTION OF THE DRAWINGS

In the drawings, like reference numbers and designations in the various drawings indicate like elements.

DETAILED DESCRIPTION

Figure 1A:
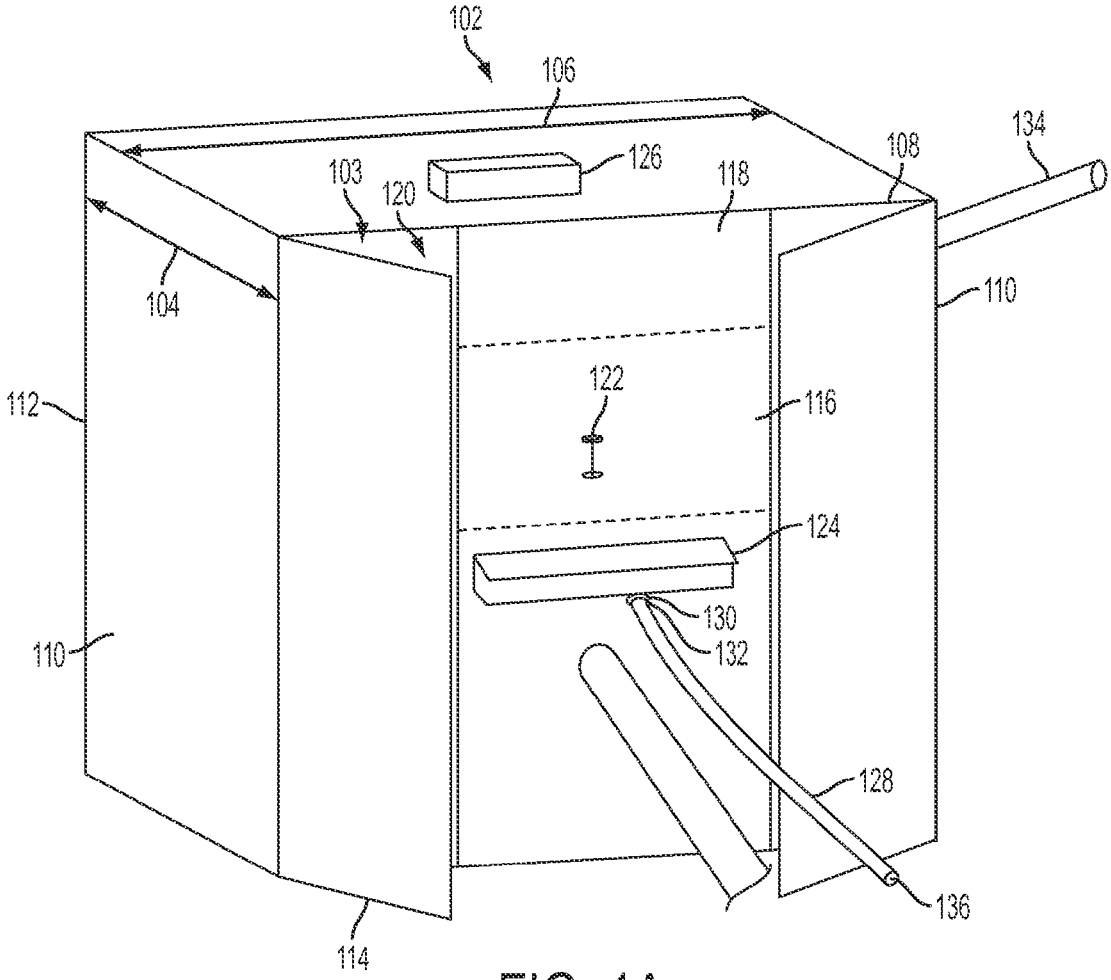
FIG. 1A is a schematic illustration showing the exterior of a refrigerated housing for a beverage dispensing system according to one embodiment.

Implementations of the present disclosure now will be described more fully. Indeed, these implementations can be embodied in many different forms and should not be construed as limited to the implementations set forth herein. As used in the specification, and in the appended claims, the singular forms "a," "an," and "the," include plural referents unless the context clearly indicates otherwise. The term "comprising" and variations thereof as used herein is used synonymously with the term "including" and variations thereof and are open, non-limiting terms.

The present disclosure relates generally to beverage dispensing devices and more particularly to a modular beverage dispensing unit that requires minimal set up time and connections. By way of example and referring to FIGS. 1A and 1B, beverage dispensing systems or parts thereof are shown. The example beverage dispensing system includes a refrigerated housing 102, and the refrigerated housing 102 has an interior space 103 with a depth 104 and a width 106. The refrigerated housing 102 includes a front 108, two sides 110, and a back 112. The refrigerated housing 102 further includes one or more doors 114 and one or more fixed panels 116 optionally on the front 108. In some embodiments, one or more doors 114 provide access to the interior space 103 of the housing and, in other embodiments, provide access to a cavity or other recess. In other embodiments, the doors 114 are on the side(s) or back of the housing. The door(s) 114 and the fixed panel(s) 116 each have an exterior portion 118 and an interior portion 120. At least one of the interior portion 120 of the door(s) 114 and the fixed panel(s) 116 may include at least one connection point, described below, that connects the at least one tap with containers stored within the housing. The interior space of the refrigerated housing optionally includes shelving. Such shelving optionally includes more than one shelf, such as shelf 140 shown in FIG. 1C.

The beverage dispensing system further includes at least one tap 122 positioned on or adjacent the exterior portion 118 of the door(s) 114 or the fixed panel(s) 116. In certain embodiments, the at least one tap 122 is located at any suitable location along the housing. The at least one tap 122 is positioned so it is in communication with the at least one communication point. The system also includes a sink 124, slotted tray, or other suitable drainage mechanism. The sink 124 is positioned generally beneath the at least one tap 122. A condensing unit 126 (see FIG. 1B) is also included, and the condensing unit 126 is positioned atop or on the side of the refrigerated housing 102, or may be positioned at any other suitable location relative to housing 102. For example, in certain embodiments, the condensing unit 126 is remote from the refrigerated housing 102 and is connected by tubing therebetween. The beverage dispensing system also includes a drainage connection 130 and drainage tubing 128. The drainage tubing 128 of the drainage connection 130 has two ends, the proximal end 132 of which is attached to the sink 124 or other drainage mechanism. In some embodiments, the drainage tubing 128 passes through the interior space 103 of the refrigerated housing 102 before reaching the drain, pump or reservoir. In some embodiments, the drain is directly connected to a waste pipe. The pump may be a sump pump that automatically evacuates a holding vessel at a set point and the pump can be directed to a waste pipe or drain, or may be any other suitable pump.

In some embodiments, the sink 124 is positioned on one of the door(s) 114 or one of the fixed panel(s) 116 generally below the at least one tap 122. In other embodiments, the sink is positioned below the door(s) 114 or the fixed panel(s) 116, or at any other suitable location. The beverage dispensing system may also include at least one incoming tube 134. In some embodiments, the incoming tube(s) 134 provides carbon dioxide and/or nitrogen gas to the at least one connection point at the at least one tap or for entrance into the interior space 103 of the refrigerated housing 102. The incoming tube(s) 134 may be positioned near or juxtaposed to other incoming or outgoing tubes, lines or supplies, or any combination thereof, or may be located at any other suitable location. Optionally, the incoming and outgoing tubes(s) enter near the top of the refrigerated housing, but the entrance point can be selected based on the specific needs and sources at the location of use for the specific beverage dispensing system. In other embodiments, the carbon dioxide and/or nitrogen gas is provided from canisters stored within the housing.

Figure 1B:
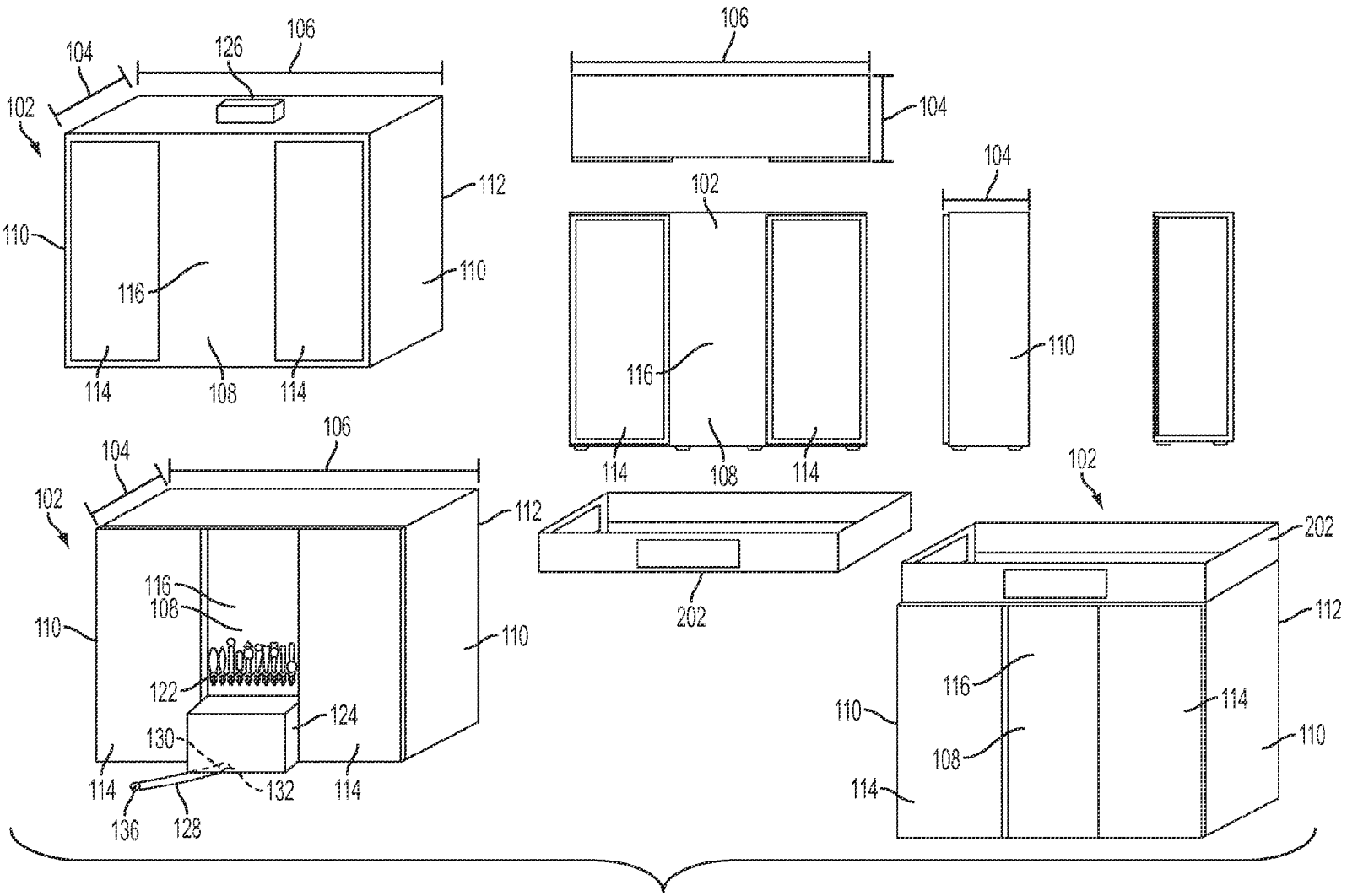
FIG. 1B shows schematic illustrations of various embodiments of beverage dispensing systems from various perspectives.
Figure 1D:
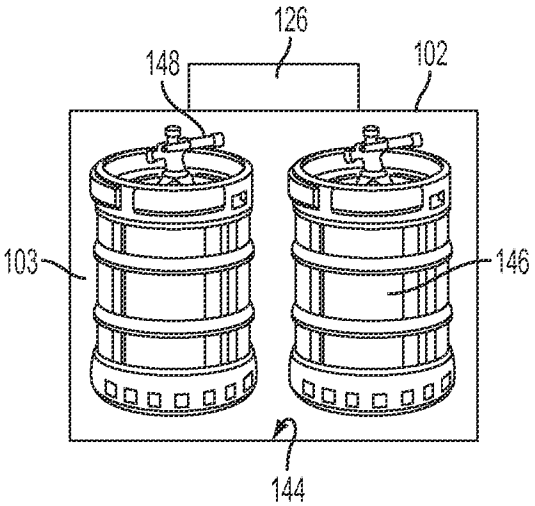
FIGS. 1C and 1D are schematic illustrations showing cross-sections of beverage dispensing systems according to two embodiments.
Figure 1C:
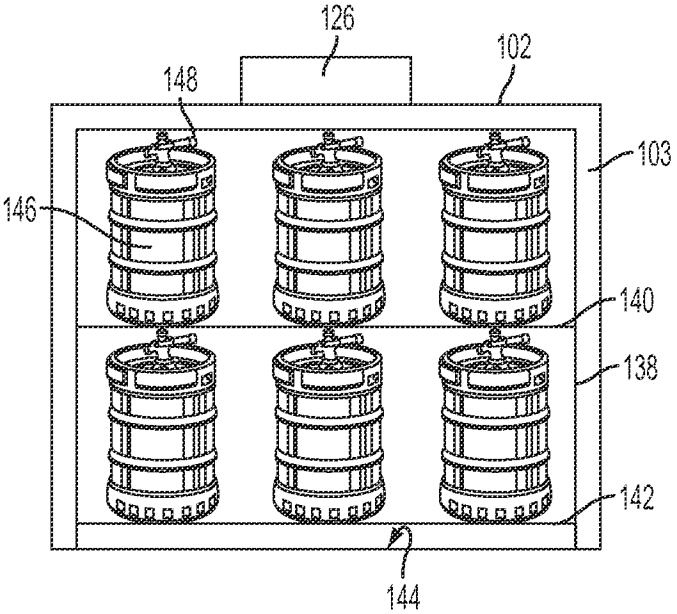
Figure 6:
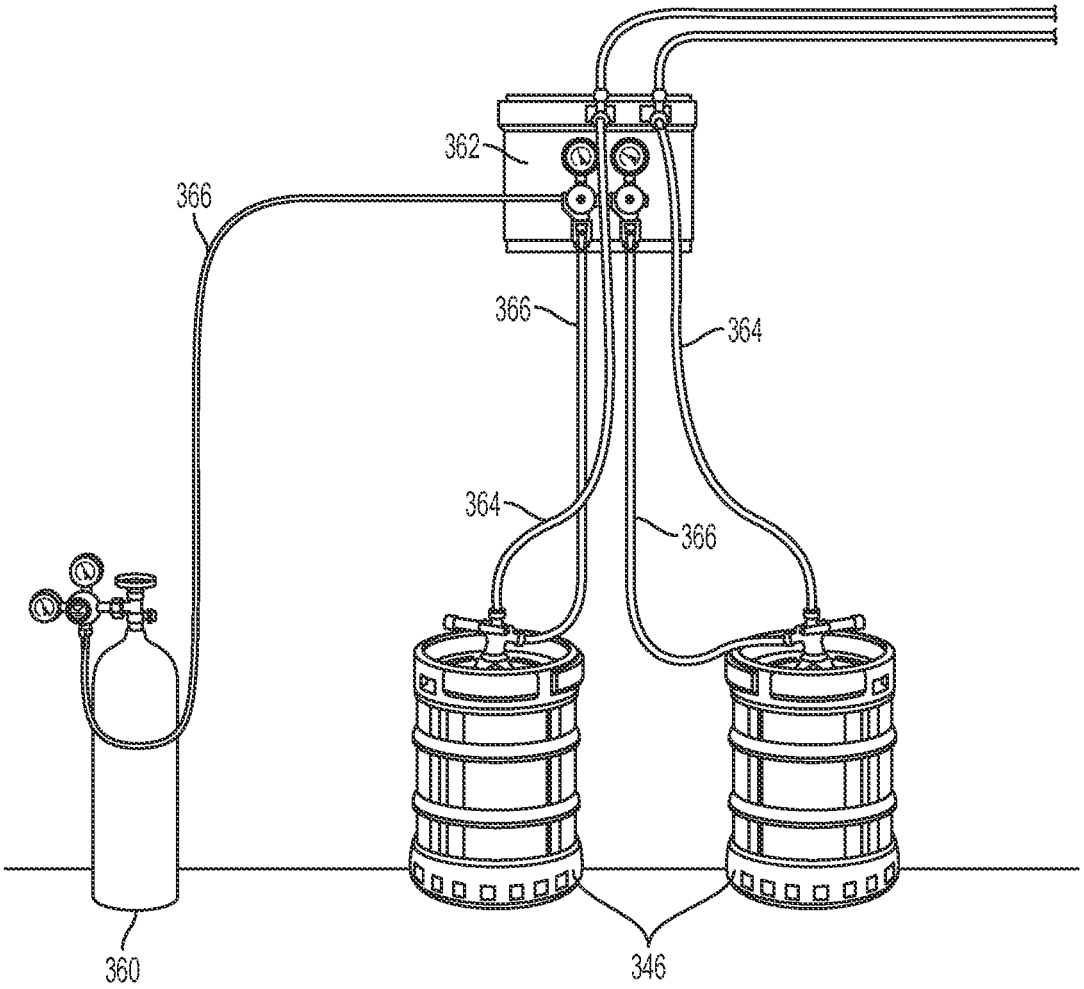
FIG. 6 is a schematic showing the connection of a carbon dioxide canister according to one embodiment.

Referring now to FIGS. 1C and 1D, portions of the interior space of the beverage dispensing systems are shown. Optionally, the interior space 103 of the refrigerated housing 102 is configured to house at least one beverage container 146. The at least one beverage container 146 may be, but is not limited to, a tank, canister, keg or other suitable container capable of holding wine, soda, water, or other suitable beverage. The container(s) can be of various sizes including those currently available in the industry, for example, legs, quarter kegs, half kegs, pony kegs, and the like. The container can have any suitable dimensions such as, but not limited to, 9, $9^{1/4}$, $11^{1/8}$, $16^{1/8}$, or 17 inches in diameter and $13^{7/8}$, 23, or $23^{3/8}$ inches tall. As mentioned above, the interior space 103 optionally includes a tank or canister of gas, for example, for carbonation. If a tank or canister of gas is used for carbonation, tubes or other suitable conduits (such as tubes 366 in FIG. 6) may direct the carbon dioxide or other suitable gas from the tank or canister of gas (such as canister 360 shown in FIG. 6) to the at least one beverage container 346. In some embodiments, regulators, such as regulators 362, may be used to regulate the volume of gas that is delivered to the beverage containers 346. The gas canister, tank or other source may be within, near, or remote from the refrigerated housing 102. In some embodiments, one or more gas canisters or tanks are used to service one or more beverage containers. If more than one beverage container is serviced by a canister or tank, a splitter or connection may be used to allow multiple lines to feed from a single tank and supply numerous containers, as shown in FIG. 6. Each beverage container (such as 146 or 346) has at least one outlet tube (such as outlet tube 364 in FIG. 6) for supplying the beverage stored within the beverage container to a tap.

In some embodiments, the at least one beverage container 146 may be positioned on shelving (such as shelf 140 shown in FIG. 1C or shelf 340 in FIG. 7) or on the floor 144 of the interior space. In one embodiment, the interior shelving in the refrigerated housing 102 may include an upper shelf 140 and a lower shelf 142 (such as those shown in FIG. 1C). In other embodiments, the at least one beverage container 146 may sit on the floor 144 or on the lower shelf 142 and/or may be stacked with other beverage containers. In some embodiments, at least two containers 146 are on the floor 144 or on the lower shelf 142, and two containers 146 are atop the other two containers 146 or on the upper shelf 140. In other embodiments, at least three containers 146 are on the floor 144 or on the lower shelf 142, and three containers 146 are atop the other three containers 146 or on the upper shelf 140. In still other embodiments, at least four containers 146 are on the floor 144 or on the lower shelf 142, and four containers 146 are atop the other four containers 146 or on the upper shelf 140. In still other embodiments, at least five containers 146 are on the floor 144 or on the lower shelf 142, and five containers 146 are atop the other five containers 146 or on the upper shelf 140. In still other embodiments, at least six containers 146 are on the floor 144 or on the tower shelf 142, and six containers 146 are atop the other six containers 146 or on the upper shelf 140. In still other embodiments, at least seven containers 146 are on the floor 144 or on the tower shelf 142, and seven containers 146 are atop the other seven containers 146 or on the upper shelf 140. In still other embodiments, at least eight containers 146 are on the floor 144 or on the tower shelf 142, and eight containers 146 are atop the other eight containers 146 or on the upper shelf 140. In still other embodiments, at least nine containers 146 are on the floor 144 or on the lower shelf 142, and nine containers 146 are atop the other nine containers 146 or on the upper shelf 140. In still other embodiments, at least ten containers 146 are on the floor 144 or on the lower shelf 142, and ten containers 146 are atop the other ten containers 146 or on the upper shelf 140. In the absence of shelving, the containers can be stacked directly on the floor or atop other containers.

As mentioned, the beverage dispensing system may also include container tubing 148 or pipes. The container tubing 148 connects the at least one connection point for the at least one tap 122 to the at least one beverage container 146. In some embodiments, one container is connected to one tap or connection point thereto. Thus, in some embodiments, multiple containers require multiple taps. In certain embodiments, multiple beverage containers and multiple taps will be used, but the size and configuration of the container and taps will be selected based on the specific use and configuration and the location for use of the beverage dispensing system.

In this and other embodiments, each beverage container 146 is equipped with an inlet for carbon dioxide or other gas used to displace the liquid within the container and to drive it into an outlet tube (such as tubing 148 in FIG. 1C or tubing 364 in FIG. 6) that routes to the tap. Each beverage container is equipped with a connection point for the at leas one inlet and at least one outlet.

The at least one tap 122 may include any suitable number of taps. In the embodiment of FIG. 1A, the at least one tap 122 is positioned along the fixed panel 116. In some embodiments, the system includes up to 20 or more taps. Generally, the larger the refrigerated housing, the more taps can be accommodated because there is space to house the beverage container associated with each tap. The user has the option of using only a subset of the available taps. For example, the user could have 3 containers and 4 taps at any given time. Similarly, the user may only utilize a portion of the available container space. For example, if the refrigerated housing has the capacity for 4 containers and four taps, the user may only utilize 3 containers at a given time.

In some embodiments, the depth 104 of the interior space 103 may measure at least 10 inches, or may have any other suitable dimension. In some embodiments, the depth 104 is large enough to accommodate one or more rows of large kegs. In some embodiments, the depth can be at least 20 inches or longer including 34 inches, or 40 inches. The height the interior of the refrigerated housing or the height between shelves is similarly dimensioned based on the size of containers to be stored within the housing. Thus, the height may be 15 inches or taller, including for example, 24 inches or taller, 25 inches or taller, or any other suitable height.

In the embodiment illustrated in FIG. 1A, the door(s) 114 of the beverage dispensing system open outward, which allows maximum interior capacity for containers within the refrigerated housing. Doors 114 of the embodiment illustrated in FIG. 1A provide access to the interior space 103 of the refrigerated housing 102, and more particularly, to the beverage containers 146 stored within the interior space 103 of the refrigerated housing 102. Thus, in this embodiment, the doors are large enough to accommodate passage of the selected size of containers into and maneuverability of the same within the interior of the refrigerated housing 102. Thus, in this embodiment, door(s) 114 are at least about 12 inches in width and height and may be larger, such as about 19 inches or 22 inches in width and height.

As shown in FIG. 1A, sink 124 or other drainage mechanism may be positioned to collect excess liquid or waste from the at least one tap 122 when, for example, a growler is filled from the tap and spillage or overflow occurs or when a tap drips or leaks. The distal end 136 of the drainage tubing 128 is optionally connectable to a waste container (reservoir), a sump pump, or a drain.

In some embodiments, one or more informational boards 202 may be included. In the embodiment shown in FIG. 3, informational board 202 is adjacent to and at least partially covering the condensing unit 126, although informational board 202 may be positioned at any suitable location along housing 102. The informational board 202 optionally is designed to inform the user of the beverages available from the beverage dispensing system. In some embodiments, an informational board is positioned near the at least one taps 122. Optionally, the informational board 202 is programmable by a computing unit or other programmable means. In other embodiments, the board is a blackboard or whiteboard for handwritten information or is a permanent display. In other embodiments, the informational board is not used.

In some embodiments, the beverage dispensing system may further include a faucet and a water supply for providing water to the faucet. For example, the water supply optionally enters the system adjacent to the condensing unit 126 and passes to the faucet through the interior space 103 of the refrigerated housing 102. The water supply allows the user to wash or rinse the growlers, taps, glasses, tubes, lids, or the like and facilitates cleaning the beverage dispensing system itself.

Optionally, the beverage dispensing system includes a power supply for providing electricity to the system and particularly to the condensing unit 126 and/or informational board 202 and/or lighting. In some embodiments, the power supply provides electricity to one or more lights on the interior or exterior of the refrigerated housing. In some embodiments, the beverage dispensing system includes one or more switches to control power to the condenser, sump pump, lights, informational board, computing or programming means, or the like.

Figure 2:
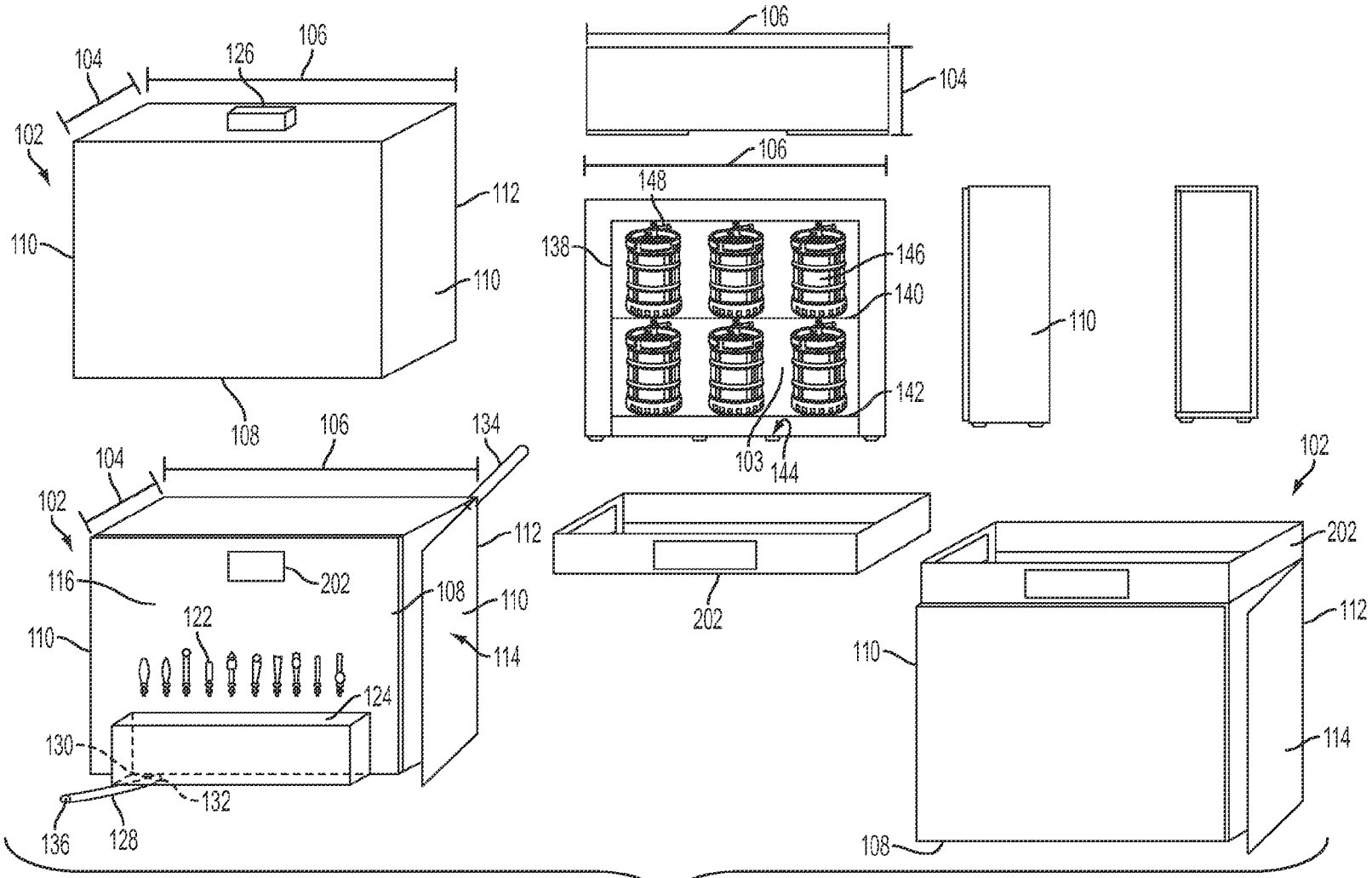
FIG. 2 shows schematic illustrations of example beverage dispensing systems.

Referring now to FIG. 2, the embodiment pictured optionally includes many of the characteristics and elements as discussed for the embodiment of FIG. 1 and additional views of the beverage dispensing systems are shown which may or may not include all the possible characteristics. As discussed above, embodiments of the beverage dispensing system include a refrigerated housing 102 having an interior space 103 with a depth 104 and a width 106. The refrigerated housing includes at least a front 108, two sides 110, and a back 112. The refrigerated housing 102 as shown further includes a door 114 on the side 110, although the door may be positioned at any suitable location along housing 102 and may include more than one door. The front 108 includes at least one tap 122 as described above. As described above, an interior portion of the front 108 includes at least one connection point that connects the at least one 122 with another source. For example, the connection point may be designed to receive beverage container tubing and/or tubing from a gas source, which in some embodiments is external to the refrigerated housing 102, although it need not be. The interior space 103 of the refrigerated housing 102, as shown, may also include shelving 138. Such shelving can include one or more shelves such as shelves 140 and 142.

Like the embodiment of FIG. 1, the beverage dispensing system also includes a sink 124 or other drainage mechanism. The sink 124 is positioned generally beneath the at least one tap 122. A condensing unit 126 is also included, and is positioned atop or on the side of the refrigerated housing 102 or at any other suitable location. For example, in other embodiments, the condensing unit is remote from the refrigerated housing and connected with the interior space of the refrigerated housing by tubing. The beverage dispensing system also includes a drainage connection 130 and drainage tubing 128. The drainage tubing 128 of the drainage connection 130 has two ends, and the proximal end 132 of which is attached to the sink 124 and the distal end of which is optionally connected to or leads to a drain, a reservoir, or a pump.

Optionally, the drainage tubing passes through the interior space 103 of the refrigerated housing 102. The sink 124 is optionally positioned on the front 108 of the refrigerated housing 102 below the at least one tap 122. However, the at least one tap 122 could be located on the same side as the door, preferably in a fixed panel on the side of the beverage dispensing system.

Like the beverage dispensing system discussed above, the beverage dispensing system may also include an incoming tube(s) 134. The incoming tube(s) 134 optionally provides carbon dioxide and/or nitrogen gas to the at least one connection point. The incoming tube(s) 134 may enter the interior space 103 of the refrigerated housing 102. The incoming tube(s) 134 are may be near or juxtaposed to other incoming and outgoing tubes, lines, or supplies as described and may enter the top, side or back of the refrigerated housing, or may be positioned at any other suitable location.

The interior space 103 of the refrigerated housing 102 is configured to house at least one beverage container 146, and preferably more than one container. The at least one beverage container 146 may be a tank, canister, keg, or other suitable container as described above and may hold any suitable beverage such as, but not limited to, beer, wine, water, or soda. As also described above, the interior space 103 optionally includes a tank or canister of gas for carbonation. The beverage dispensing system optionally also includes container tubing 148 or pipes that connect the at least one connection point for the at least one tap 122 with the at least one beverage container 146. As described above, one container may be connected to one or more taps 122 or connection points thereto; thus, multiple containers and multiple taps may be utilized with container tubing therebetween as described. As described above, shelving is optional in the interior of housing. In the absence of shelving, the containers can be stacked directly on the floor or atop other containers.

As described above, any suitable number of taps 122 may be included. Generally, the larger the refrigerated housing, the more taps so that there is roughly one tap per container. Furthermore, the depth and height of the housing is varied based on factors such as container size, container number, and the use and location of the beverage dispensing system planned and/or employed by the user. As described above, the size and shape of the doors also varies based on such characteristics. In FIG. 2, the door is configured so that it opens outward, however, in certain circumstances it may be desirable for the door to open inwardly, but additional space must be allocated for such an inward opening.

As shown in FIG. 2, the sink or other drainage mechanism is positioned to collect excess liquid or waste from the at least one tap 122 and as described herein. The distal end 136 of the drainage tubing 128 is optionally connectable to a waste container, a sump pump, or a drain.

Also as described above, an information board 202 (optionally with or without a programming or computing means), faucet, water supply, and power supply may be included. In this and other examples, the water supply is optionally from a running water line. However, if a water source is not in suitable proximity to the beverage dispensing system location, a water container and a pump inside or outside the refrigerated housing may be used to provide a water supply.

Figure 3:
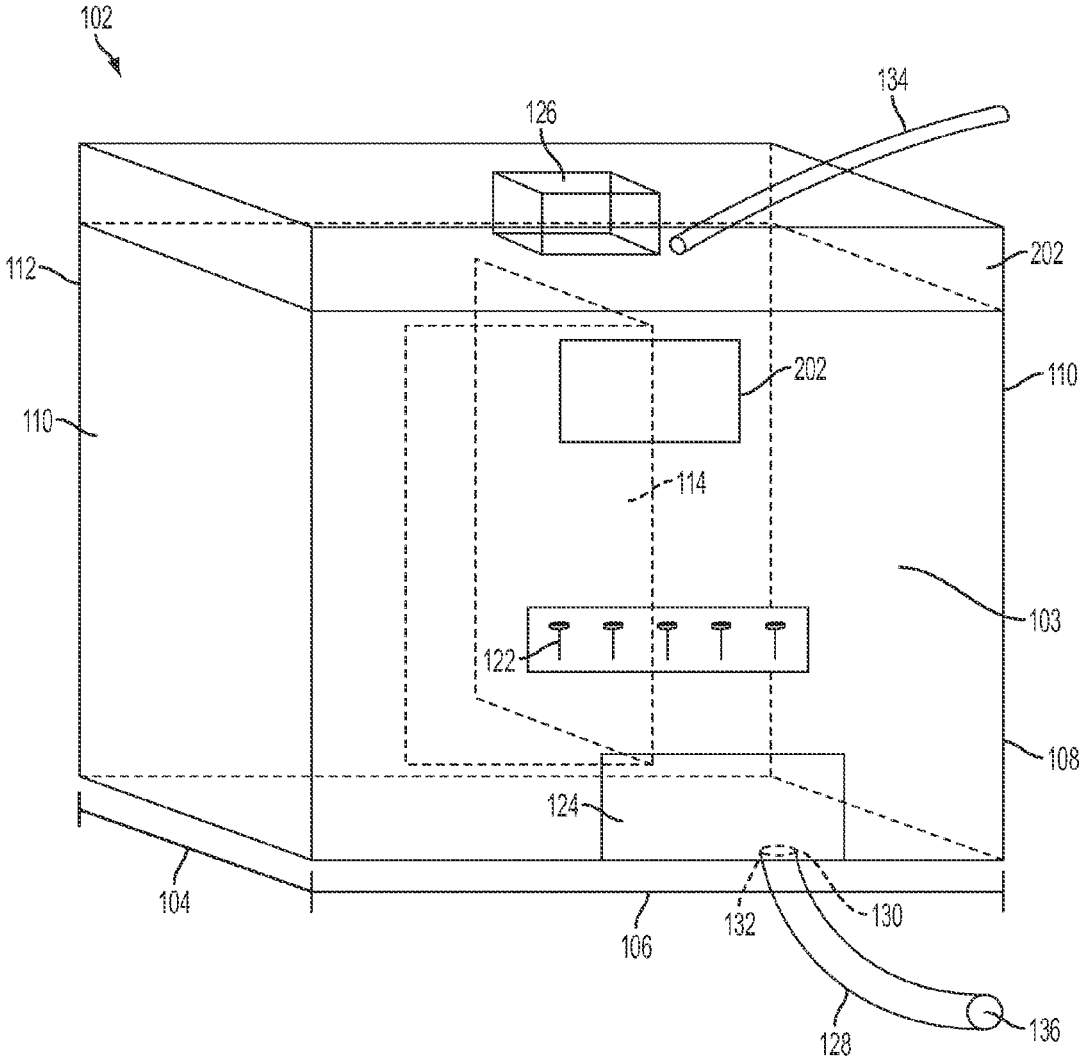
FIG. 3 is a schematic illustration of an example beverage dispensing system.

FIG. 3 illustrates another embodiment of beverage dispensing system. In this embodiment, one or more doors 114 is provided on the back of the refrigerated housing 102, although one or more doors may be provided at any suitable location along housing 102. The example beverage dispensing system includes a refrigerated housing 102 having an interior space 103 with a depth 104 and a width 106. The refrigerated housing 102 includes at least a front 108, two sides 110, and a back 112. The front 108 of the refrigerated housing 102 includes an exterior portion 118 and an interior portion 120. The sides 110 of the refrigerated housing 102 also have exterior portions 118 and interior portions 120. The exterior portion 118 of the front 108 or the side 110 of the refrigerated housing 102 includes at least one tap 112. The interior portion 120 of the same front 108 or side 110 also includes at least one connection point for connection the at least one tap 122 with another source, such as beverage containers. The interior space 103 of the refrigerated housing 102 may also include shelving, as described in the above embodiments.

As described above, the beverage dispensing system also includes a sink or other drainage mechanism, a condensing unit, and a drainage connection with drainage tubing. The sink 124 is optionally positioned on the front 108 or one of the sides 110 of the refrigerated housing 102 and below the at least one tap. As described above, incoming tube(s), at least one beverage container, and container tubing may be included. FIG. 3 shows the sink positioned to collect excess liquid or waste from the at least one tap 122. The distal end 136 of the drainage tubing 128 is optionally connectable to a waste container, a sump pump, or a drain as described.

As described above, one container is connected to one or more taps; thus, multiple containers and multiple taps may be utilized with container tubing therebetween. In the absence of shelving, the containers can be stacked directly on the floor or atop other containers. As described above, any number of suitable taps 122 may be included. Generally, the larger the refrigerated housing, the more containers and taps so that there is roughly one tap available per container or per space of containers accommodated by the housing. In this and other embodiments, the user may have the option of adding more taps if the space per container is larger than the number of taps on the system. In such a case, a capped hole or other demarcation may indicate the location for new taps.

As discussed above, the size of the housing (both depth and height) may vary, as can the height and configuration and placement of the one or more doors. The door(s) 114 of the beverage dispensing system optionally open outward and are configured to allow placement of the beverage containers 146 in the interior space 103 and maneuverability of the containers in the refrigerated housing 102.

In this and other embodiments, the doors may be large enough to allow passage of the shelving or a portion thereof into the housing; however, the housing optionally is built around the shelving so that the doors may be smaller than necessary to allow insertion of the shelving. Thus, the doors should be large enough to allow passage of the selected size of containers and maneuverability of same within the refrigerated housing 102 as described.

As described above, an information board 202 (with or without a programming or computing means), faucet, water supply, and power supply can be included.

Figure 4:
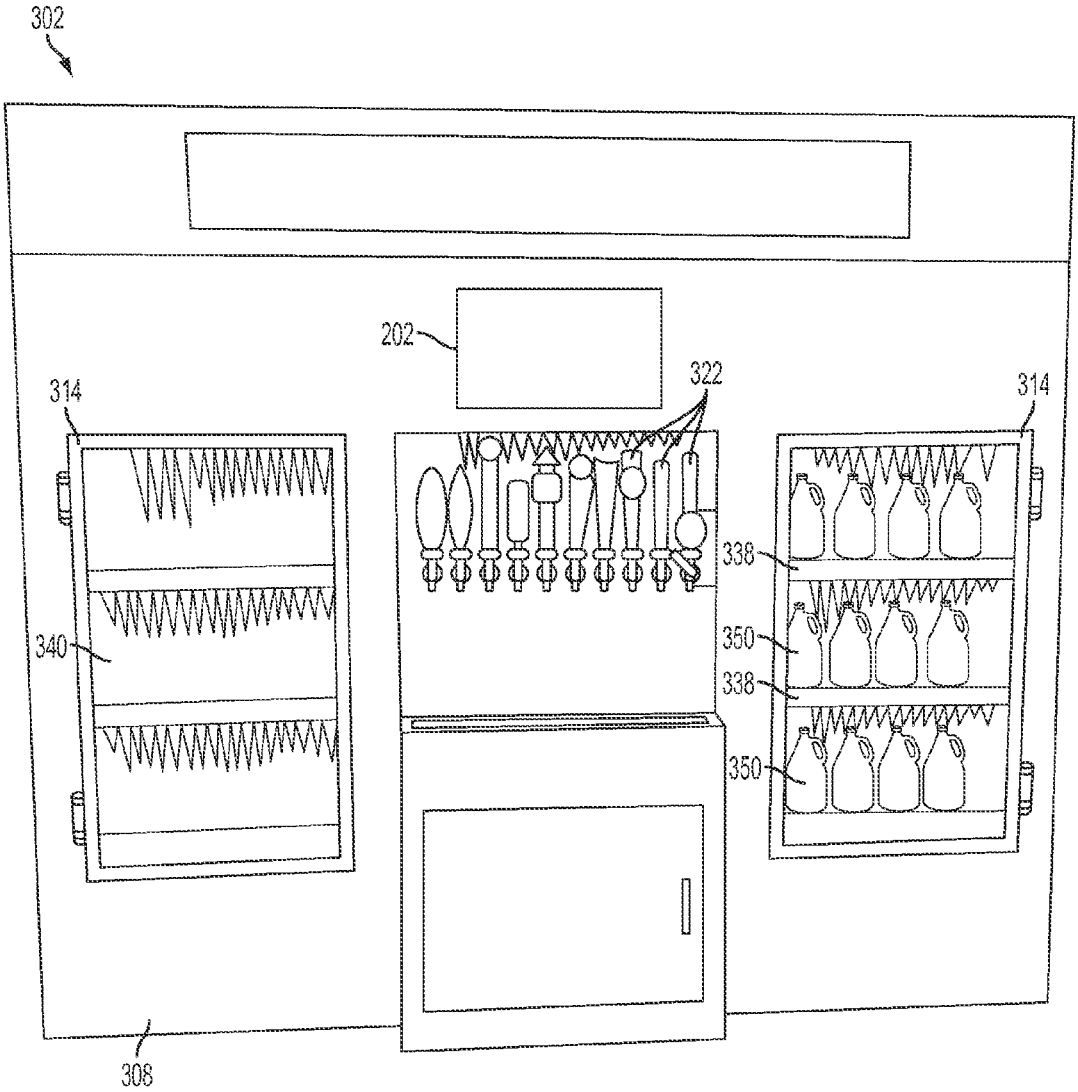
FIG. 4 is a front perspective view of a beverage dispensing system according to one embodiment.
Figure 5:
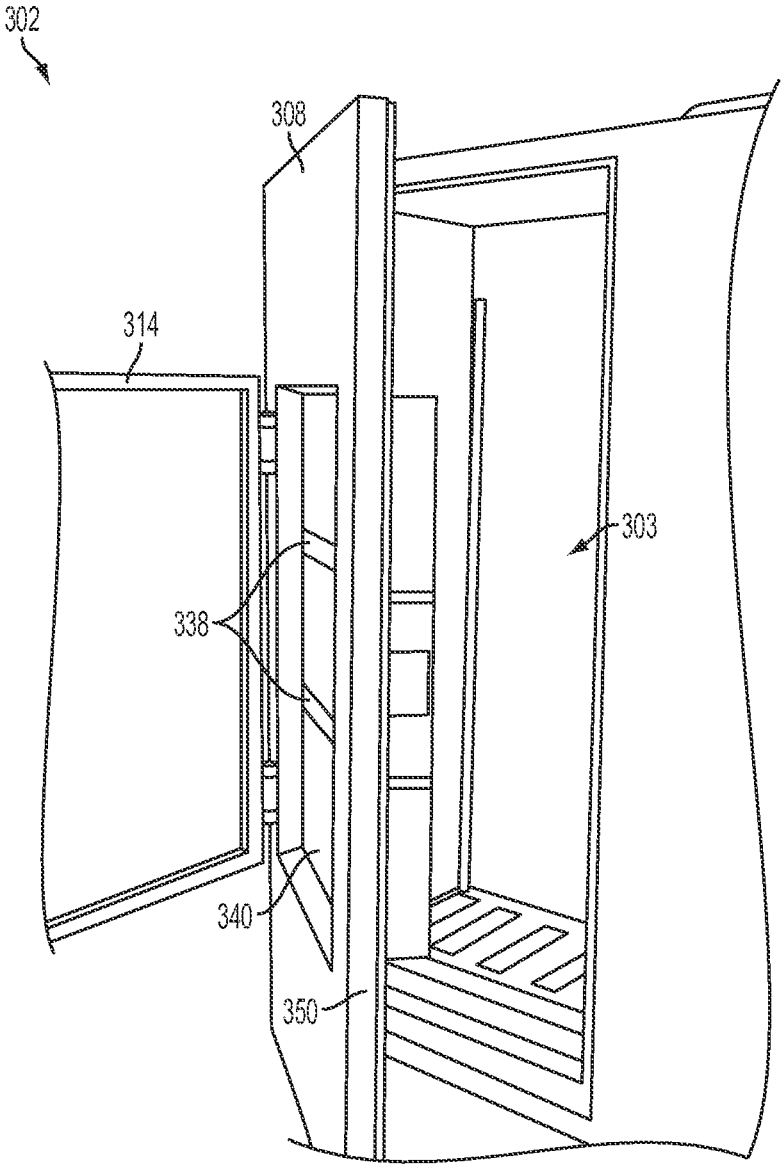
FIG. 5 is a side perspective view of the beverage dispensing system of FIG. 4, with the housing in the open position.
Figure 7:
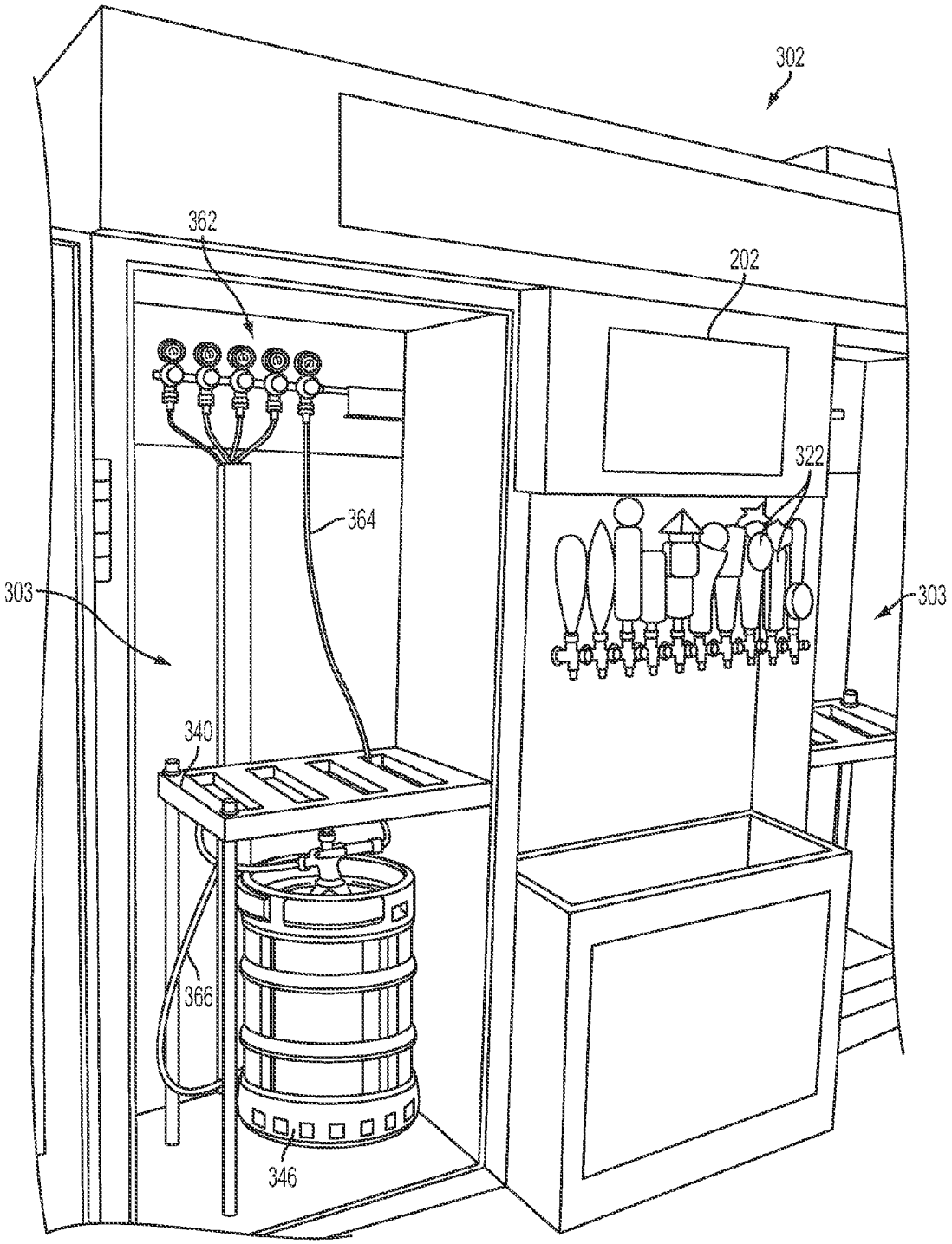
FIG. 7 is a front perspective view of the beverage dispensing system of FIG. 4 as partially assembled.

FIGS. 4-5 and 7 illustrate another embodiment of the beverage dispensing system. The embodiment illustrated in FIGS. 4-5 optionally includes some or all of the characteristics and elements as discussed for the embodiments of FIGS. 1-3. The embodiment of FIGS. 4-5 and 7 includes doors 314 that provide access to growlers or other containers housed within a cavity 340 or other recess along the front of the housing. In addition or in lieu of the front of the housing, cavity 340 may be included along on one or more sides of the housing in other embodiments. In some embodiments, cavity 340 includes shelves 338 on which the growlers 350 or other containers may be positioned. As shown in FIG. 4, doors 314 may be glass doors or otherwise transparent so that the growlers or other containers are visible to a consumer. In some embodiments, cavity 340 (and optionally other portions of housing 302, such as the area proximate taps 322) is illuminated by suitable lighting. As shown in FIG. 5, housing 302 may be also include one or more doors 350 that provides access to the interior space 303 of the housing 302. As shown in FIG. 5, one or more doors 350 may facilitate opening of at least a portion of the front 308 of the housing to provide access to one or more interior spaces 303 (see FIG. 7). In other embodiments, the back or one or both of the sides may be configured to open to provide access to the interior space. As described above, interior space 303 is configured and dimensioned to receive one or more beverage containers 346, which are in communication with one or more taps 322, as described above via one or more connection points and tubing or other suitable conduits.

The beverage dispensing units described above are designed to provide optional temperature control. For example, the units optionally allow the temperature inside the refrigerated housing to be maintained at a suitable temperature such as, but not limited to, between approximately 33° F. and 38° F. and or at around 35° F. when beer is stored in the refrigerated housing. In some embodiments, a fan may be located at the top, sides or back of the interior of the refrigerated housing and is configured to ensure an even temperature distribution within the interior of the housing. In some embodiments, the fan is flush or nearing flush with the surface of the interior so as not to minimize the interior space.

The beverage dispensing units described above are designed as a modular, portable units that can be transported to a site, including, but not limited to, a convenience store, grocery store, restaurant, gas station, or the like for easy installation. The unit requires electrical input and optionally a water supply and/or drain. The particular unit to be installed is selected based on the size and configuration of the available space. Similarly, the location of the power supply and water supply at the selected site will determine where the entry point or exit point of the various tubing, lines and supplies are located on the beverage dispensing unit.

Each module may be designed and otherwise configured to fit the space and demands available. Thus, the number and size of the beverage containers desired or needed determines the width and height of the refrigerated housing unit and/or the number of taps. The size of the beverage dispensing system will also be selected based on whether the system must fit within an existing location, for example, within the confines of an aisle in an existing store.

The placement of the door(s) and/or fixed panels and/or tap(s) is selected based on the location and arrangement where the beverage dispensing unit will be placed for use. For example, if the unit will be placed with the back of the unit against a wall, the door or taps must be on the front or side of the refrigerated housing. If the unit will be placed in a corner with the back and first side placed in the corner, and for example a counter juxtaposed on the second side, then the door(s) must be placed on the front.

Provided herein is also a method of dispensing beverages into a growler or other transportable container using a beverage dispensing system described herein. The method may be performed in a grocery store, convenience store, beverage store, restaurant, or any other suitable establishment. Optionally the method is performed by an employee of the store or restaurant; however, a consumer or other suitable user could perform the method. The method optionally comprises precooling the tubing for dispensing. The method optionally comprises sealing the growler or transportable container using, for example, a heat sealed cover and heating means or a lid once the growler or transportable container has been filled from the beverage containers. In some embodiments, the method also comprises pouring the beverages into a glass or other container for consumption on the premises.

Many modifications and other embodiments of the disclosure set forth herein will come to mind to one skilled in the art to which this disclosure pertains having the benefit of the teachings presented in the foregoing description. Therefore, it is to be understood that the disclosure is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A beverage dispensing system comprising:

(a) a refrigerated housing defining an interior space with a depth and a width, the refrigerated housing comprising:
  (i) a front, two sides, and a back;
  (ii) one or more fixed panels positioned along the front, wherein a plurality of taps are positioned along at least one of the one or more fixed panels at a vertical position between a top and a bottom of the refrigerated housing; and
  (iii) at least two doors, wherein the at least one of the one or more fixed panels is positioned between two of the at least two doors;

wherein the housing has an open position and a closed position, and wherein, in the open position, the interior space is accessible from an exterior of the refrigerated housing and, in the closed position, the interior space is not accessible from the exterior of the refrigerated housing;

(b) at least one connection point in communication with at least one of the plurality of taps and positioned along an interior portion of the refrigerated housing;

(c) a drainage mechanism positioned substantially beneath the plurality of taps;

(d) a condensing unit configured to cool the interior space; and (e) a cavity distinct from the interior space, the cavity positioned in one of the at least two doors and accessible from the exterior of the refrigerated housing, wherein a panel door is connected with the at least two doors and proximate the cavity so as to provide selective access to the cavity from the exterior of the refrigerated housing.

2. The beverage dispensing system of claim 1, wherein the cavity comprises one or more shelves.

3. The beverage dispensing system of claim 1, further comprising lighting to illuminate the cavity.

4. The beverage dispensing system of claim 1, further comprising an incoming tube configured to provide at least one of carbon dioxide and nitrogen gas to the at least one connection point, wherein the incoming tube enters the interior space of the refrigerated housing.

5. The beverage dispensing system of claim 4, wherein the panel door is transparent.

6. The beverage dispensing system of claim 5, further comprising at least one beverage container housed in the interior space of the refrigerated housing.

7. The beverage dispensing system of claim 6, wherein the at least one beverage container is on shelving.

8. The beverage dispensing system of claim 7, further comprising container tubing that connects the at least one connection point to the at least one beverage container.

9. The beverage dispensing system of claim 1, further comprising at least a lower shelf and an upper shelf.

10. The beverage dispensing system of claim 9, wherein at least one container is on the lower shelf and at least another container is atop another container or is on the upper shelf.

11. The beverage dispensing system of claim 1, wherein the depth of the interior space is at least 10 inches.

12. The beverage dispensing system of claim 1, wherein the at least two doors provide access to the interior space of the refrigerated housing.

13. The beverage dispensing system of claim 1, wherein the panel door provides access to the cavity along the front or one of the two sides of the refrigerated housing.

14. The beverage dispensing system of claim 1, wherein the drainage mechanism comprises a sink positioned below the plurality of taps.

15. The beverage dispensing system of claim 1, further comprising an information board that is adjacent to and at least partially covering the condensing unit.

16. The beverage dispensing system of claim 1, wherein the beverage dispensing system further comprises:

a faucet distinct from the plurality of taps; and a water supply for providing water to the faucet.

17. The beverage dispensing system of claim 16, wherein the water supply enters the system adjacent to the condensing unit.

18. A beverage dispensing system comprising:

(a) a refrigerated housing comprising a top, a bottom, a front, a back, and two substantially parallel upright lateral sides arranged substantially perpendicular to the front and the back, wherein the front, the back, and the two lateral sides extend substantially to a surface relative to which the refrigerated housing is positioned and wherein the refrigerated housing defines an interior space with a depth between the front and the back, a width between the two lateral sides, and a height between the top and the bottom, the depth, the width, and the height of the interior space sized to accommodate two or more kegs therein, the height being at least approximately 31 inches so as to accommodate at least two of the two or more kegs being stacked upright one above another, the refrigerated housing comprising one or more fixed panels positioned along the front of the refrigerated housing and further comprising two doors, wherein a first of the two doors is positioned left of the one or more fixed panels and a second of the two doors is positioned right of the one or more fixed panels such that the one or more fixed panels is between the two doors;

(b) at least two taps, each of the at least two taps positioned on one of the one or more fixed panels along the front of the housing at a vertical position away from both the top and the bottom of the housing, each of the at least two taps in communication with at least one connection point configured for connecting at least one of the at least two taps to at least one of the two or more kegs when the two or more kegs are accommodated in the interior space;

(c) a drainage mechanism positioned substantially beneath at least one of the at least two taps;

(d) a condensing unit configured to cool the interior space of the refrigerated housing;

(e) one or more shelves positioned within the refrigerated housing and arranged so as to accommodate at least two of the two or more kegs being stacked upright one above another; and (f) a cavity distinct from the interior space, the cavity positioned in one of the two doors and accessible from an exterior of the refrigerated housing, wherein a panel door is connected with the one of the two doors and proximate the cavity so as to provide selective access to the cavity from the exterior of the refrigerated housing.

19. The beverage dispensing system of claim 18, wherein the drainage mechanism comprises a sink positioned along the front of the housing.

20. The beverage dispensing system of claim 18, further comprising an incoming tube configured to provide at least one of carbon dioxide and nitrogen gas to the at least one connection point.

21. The beverage dispensing system of claim 18, further comprising at least three kegs housed in the interior space of the refrigerated housing.

22. The beverage dispensing system of claim 18, wherein the one or more shelves further comprises an upper shelf and a lower shelf.

23. The beverage dispensing system of claim 18, wherein the two doors enables the housing to move from a closed position to an open position, wherein, in the open position, the interior space is accessible from an exterior of the refrigerated housing and, in the closed position, the interior space is not accessible from the exterior of the refrigerated housing.

24. The beverage dispensing system of claim 18, wherein the two doors is provided along the front of the housing.

25. The beverage dispensing system of claim 18, further comprising an information board that is adjacent to and at least partially covering the condensing unit.

26. The beverage dispensing system of claim 18, wherein the cavity comprises at least one shelf.

27. The beverage dispensing system of claim 18, further comprising lighting configured to illuminate the cavity.

28. A beverage dispensing system comprising:

(a) a refrigerated housing comprising a top, a bottom, a front, a back, and two substantially parallel upright lateral sides arranged substantially perpendicular to the front and the back, wherein the front, back, and sides extend substantially to a floor on which the beverage dispensing system is positioned, the refrigerated housing defining an interior space with a depth between the front and the back, a width between the lateral sides, and a height between the top and the bottom, the depth, the width, and the height of the interior space sized to accommodate two or more kegs therein, the height being at least approximately 31 inches so as to accommodate at least two of the two or more kegs being stacked upright one above another, the refrigerated housing comprising one or more fixed panels positioned along the front of the housing and located between two doors, wherein a first end of the one or more fixed panels is proximate a first of the two doors and a second end of the one or more fixed panels opposite the first end is proximate a second of the two doors;

wherein the housing has an open position and a closed position, and wherein, in the open position, the interior space is accessible from an exterior of the refrigerated housing and, in the closed position, the interior space is not accessible from the exterior of the refrigerated housing;

(b) one or more shelves positioned within the refrigerated housing and arranged so as to accommodate at least two of the two or more kegs being stacked upright one above another;

(c) at least two taps positioned along the one or more fixed panels of the front of the housing at a vertical position away from both the top and the bottom of the housing, each of the at least two taps in communication with at least one connection point configured for connecting at least one of the at least two taps to at least one of the two or more kegs when the two or more kegs are accommodated in the interior space;

(d) a sink positioned substantially beneath the at least two taps;

(e) a waste container connected to the sink;

(f) a condensing unit configured to cool the interior space; and (g) a cavity distinct from the interior space and comprising shelving, the cavity positioned in one of the two doors and accessible along the exterior of the refrigerated housing, wherein a panel door is connected with the one of the two doors and proximate the cavity so as to provide selective access to the cavity from the exterior of the refrigerated housing.

29. The beverage dispensing system of claim 28, further comprising a drainage connection and drainage tubing, wherein the drainage tubing of the drainage connection comprises a proximal end and a distal end and wherein the proximal end of the drainage tubing is attachable to the sink.

30. The beverage dispensing system of claim 28, wherein the two doors enables the interior space to be selectively accessible.

31. The beverage dispensing system of claim 28, further comprising at least three kegs housed inside the refrigerated housing.

32. The beverage dispensing system of claim 28, wherein the one or more shelves comprises an upper shelf and a lower shelf.

33. The beverage dispensing system of claim 28, further comprising an information board that is adjacent to the condensing unit.

34. The beverage dispensing system of claim 28, wherein the panel door is transparent and further comprises lighting for illuminating the cavity.

35. The beverage dispensing system of claim 28, wherein the cavity further comprises shelving.

* * * * *